US008505127B2

(12) United States Patent
Kim

(10) Patent No.: US 8,505,127 B2
(45) Date of Patent: Aug. 13, 2013

(54) METHOD AND SYSTEM FOR HEATING A SAUNA

(76) Inventor: Byung T. Kim, Fort Lee, NJ (US)

( * ) Notice: Subject to any disclaimer, the term of this patent is extended or adjusted under 35 U.S.C. 154(b) by 988 days.

(21) Appl. No.: 12/568,917

(22) Filed: Sep. 29, 2009

(65) Prior Publication Data

US 2010/0077546 A1 Apr. 1, 2010

Related U.S. Application Data

(60) Provisional application No. 61/100,938, filed on Sep. 29, 2008.

(51) Int. Cl.
*A61H 33/06* (2006.01)

(52) U.S. Cl.
USPC ..... 4/524

(58) Field of Classification Search
USPC ..... 4/524–534
See application file for complete search history.

(56) References Cited

U.S. PATENT DOCUMENTS

| | | | | |
|---|---|---|---|---|
| 3,314,666 | A * | 4/1967 | Gajardo | 432/82 |
| 3,685,060 | A * | 8/1972 | Bemberg | 4/524 |
| 4,718,847 | A * | 1/1988 | Manson | 432/241 |
| 4,961,683 | A * | 10/1990 | van Huet | 414/783 |
| 5,003,158 | A * | 3/1991 | Erkki | 392/435 |
| 5,827,457 | A * | 10/1998 | Tseng | 264/43 |
| 6,041,769 | A * | 3/2000 | Llodra et al. | 126/41 R |
| 6,692,544 | B1 * | 2/2004 | Grillenzoni | 44/589 |
| 7,070,384 | B2 * | 7/2006 | Keyes | 414/789.8 |
| 7,904,974 | B2 * | 3/2011 | Salomonsson | 4/524 |
| 2008/0092287 | A1 * | 4/2008 | Salomonsson | 4/524 |

FOREIGN PATENT DOCUMENTS

| | | | |
|---|---|---|---|
| DE | 3518592 | A1 * | 11/1986 |
| DE | 3819959 | A1 * | 12/1989 |
| DE | 4226689 | A1 * | 2/1994 |

* cited by examiner

*Primary Examiner* — Lori Baker
(74) *Attorney, Agent, or Firm* — Gottlieb, Rackman & Reisman, PC

(57) ABSTRACT

A heating source placed upon a transportable vehicle is electrically heated in an oven and transported to the room via rail. Heat from the payload is dissipated into the room and, after the ambient temperature lowers back down, the vehicle and payload are returned to the oven for subsequent re-heating.

16 Claims, 3 Drawing Sheets

METHOD AND SYSTEM FOR HEATING A SAUNA

The present invention claims priority to provisional U.S. Application No. 61/100,938, filed on Sep. 29, 2008, which is incorporated herein by reference.

BACKGROUND OF THE PRESENT INVENTION

1. Field of Invention

This invention pertains to a structure for heating a sauna wherein a stack of bricks with high heat retention properties is selectively shifted between an oven and a sauna for heating the latter.

2. Description of the Prior Art

Heated spas and saunas have been used for many years for different therapeutic purposes. Various methods have been used to heat such rooms or other areas with a spa. One common method presently used is to indirectly heat a sauna by first convectionally elevating the temperature of a movable heat source to a high temperature in an oven, transporting the heated source to the room, and allowing the source to radiate its heat, thereby providing a safe dry heating means for the sauna.

As can be appreciated, because of size and temperature, a high temperature sauna within a spa system has only limited redundancy built into its heating plant. Therefore, when a part fails, the entire spa system often must be shut down. Because of the high temperatures involved, such shutdowns can be lengthy because of the time required for cooling down the oven to a safe temperature, human intervention for repair, and subsequent heat up. Further, present systems also require frequent maintenance, and therefore require periodic shutdowns. It would be preferable to have a system requiring far less maintenance and a system which is significantly less prone to failure.

In the prior art, an oven is heated using a gas-fired combustion burner. The gas-fired burner heats air in a plenum to very high temperatures and a fan is used to direct the heated air through duct work and into the oven, thereby heating the oven and a movable heat source in the oven. The elevated temperatures (typically in excess of 800° F.) necessary to heat the structure are achieved using a gas-fired system, which requires a significant open flame emanating within the combustion burner. Such a system operating at high temperatures and with an open flame and duct work, is conformant to the regulatory codes of some but not all municipalities. Even when permitted, such an open flame presents a significant fire and health hazard. Further, the flame is generated by a burner disposed at a fair distance from the oven, which requires duct work of significant length and complexity. Depending upon the distance from the burner, the duct work may include bends and turns. Standard duct work is prone to leaks, cracking, and heat loss at these high temperatures. The result is that the overall system is not as energy efficient. Further, because the duct work itself transports very hot air, it must be kept in areas away from those people tend to be in. Generally speaking, the duct work requires frequent maintenance because it is operating at much higher temperatures than normal duct work. Moreover, because no such duct work is in use in any other industry, it must be custom made for the particular sauna and is very expensive.

In addition, because of the distance from the combustion chamber of the burner to the oven, a plurality of blade fans is often used in the prior art to force hot gases to the oven. These blade fans are also prone to failure when operating at high temperatures and also require appreciable maintenance because the temperatures typically are far in excess of the normal operating temperatures of such fans.

Further, in the prior art, the heated structure rests on a carriage and the carriage is transported from the oven to the spa using a chain-based system. Typically the carriage is attached to a chain and a motor pulls the chain, thereby moving the structure between the oven and the sauna. The chain-based system also requires frequent maintenance and is prone to failure because of high temperature use, temperature extremes, and structural weight.

In addition, the oven and sauna are separated from each other by a door. In the prior art, the door is latched by four air cylinders. These air cylinders must operate in unison so as to allow the doors to function properly, but the air cylinders also are prone to failure and also require frequent maintenance.

The present invention overcomes these limitations by providing for a system and method for heating a sauna without use of gas-fired burners, duct work, or blade fans. The present invention also overcomes the limitation of chain systems for vehicle transport in high temperature environments.

It is an object of the present invention to provide a method and system for heating a sauna with a system employing a much lower failure rate as compared with the failure rate of systems existing in the prior art and where the need for regular maintenance is significantly reduced from that required in the prior art.

It is also an object of the present invention to provide a method and system for heating a sauna without direct use of a combustion source.

It is also an object of the present invention to provide a method and system for heating a sauna by transporting a heated structure without use of a chain-based drive.

It is also an object of the present invention to provide a method and system for circulating air in an oven without use of blade fans.

SUMMARY OF THE INVENTION

The present invention overcomes these limitations by introducing a method and system for heating a heat retaining structure ("a heat source") having a high heat capacity and used to radiantly heat a room such as a sauna, whereby the structure is heated in an oven using an electrical source comprising a plurality of electrical heating elements. In addition, air within the oven is circulated using at least one plug fan. In the present invention, the structure is transported to the sauna by a vehicle, which is driven through use of an electrical gear motor drive attached to the vehicle's axle and remotely controlled. The door separating the oven from the sauna is operated by an electrical gear motor drive. In addition, the present invention introduces manual control of oven functions.

DETAILED DESCRIPTION OF THE PRESENT INVENTION

The present invention is directed to a system and method for heating a room and, in particular, heating a sauna.

In general, the present invention is further directed to a system and associated methods for convection heating a collection of heat-retaining objects formed as a structure and serving as a heating source, transporting the structure to a second room, allowing the structure to radiantly heat the second room, and then returning the structure to the first room for re-heating.

Figure 1:
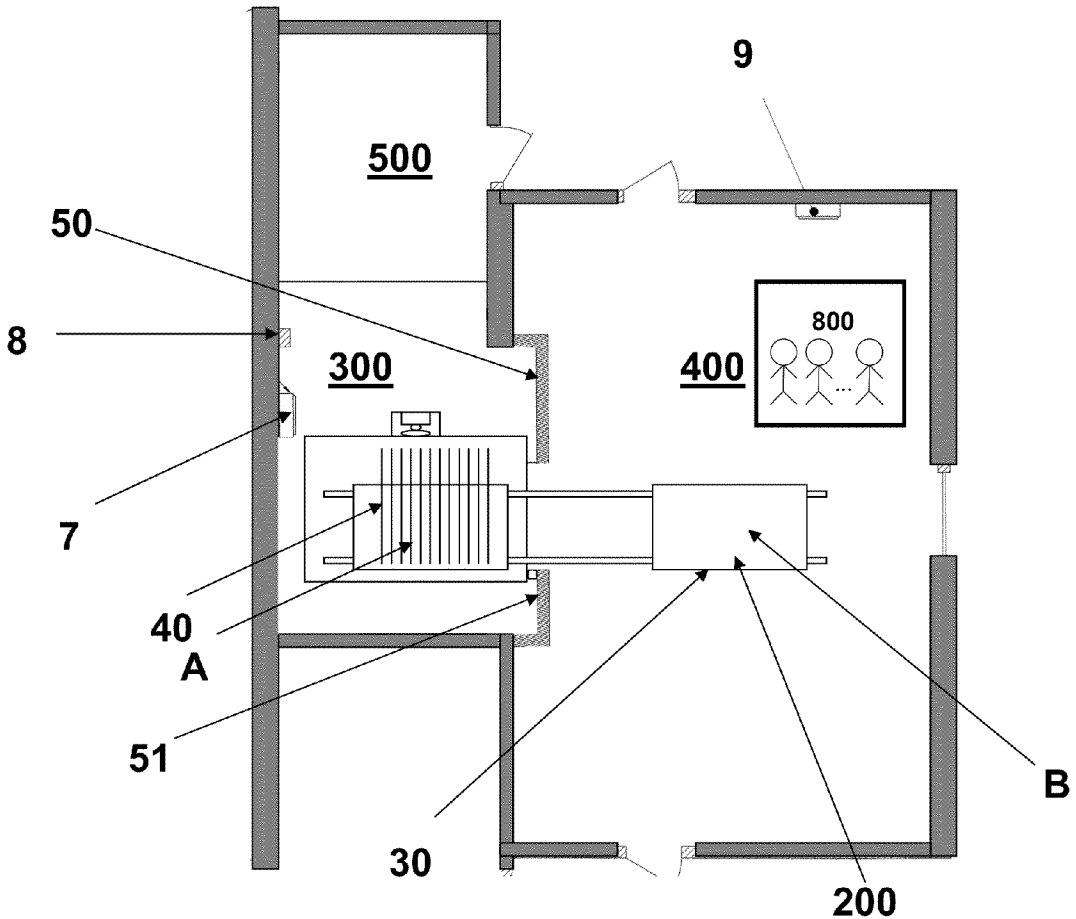
FIG. 1 is a plan view of the relative placement of the oven, sauna, and associated control room, particularly identifying the location of heating elements.

The reader is directed to FIG. 1, which shows the relative positions of the various rooms including oven 300 and sauna 400. Oven 300 is nominally 10 feet by 10 feet by 10 feet. In the preferred embodiment, oven 300 is made of heavy duty carbon steel frame with a carbon steel shell, an inside lining, and a 6 inch spun ceramic fiber core, although other structures providing similar physical and thermal properties may alternatively be used.

Sauna 400 is a room in close proximity to and sharing at least a portion of a common wall with oven 300, nominally 25 feet wide by 35 feet long and 10 feet high and is itself insulated for heat retention. A section of sauna 400 is reserved for car 200, supporting a heat retaining source. In the preferred embodiment, the heat source consists of a plurality of bricks arranged in a stack or structured way. This heat source dissipates its retained heat such that it heats sauna 400. As can be seen in FIG. 1, rails 30 extend between the sauna and the oven in sauna 400 to accommodate a plurality of patrons 800. Car 200 with the heat source can be selectively moved into and out of sauna 400 over rails 30.

Oven 300 and sauna 400 are separated by doors 50 which, in the preferred embodiment are selectively opened and closed by electrically activated gear motors (not shown). A first remote panel 9 is used to power and control the movement of car 200. Nominally, first remote panel 9 is preferably a single phase, six amp, 120 V panel and is located in or near sauna 400.

Control room 500 adjoins oven 300. Control room 500 includes a physical access means (typically a sliding door) into oven 300 for maintenance and repair purposes. Control room 500 is used to provide power to oven 300 and to provide manual control of doors 50 and car 200.

Figure 2:
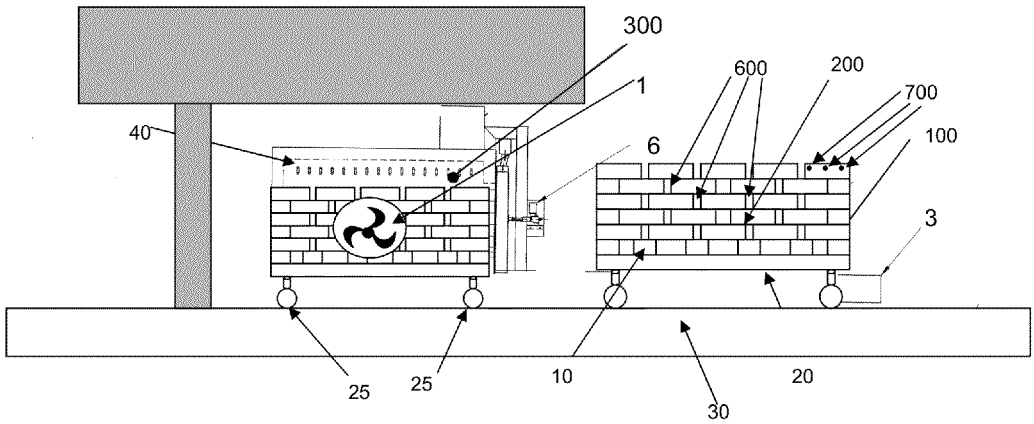
FIG. 2 is a perspective view of the vehicle and rail arrangement in the oven and sauna.

The reader is directed to FIG. 2, which depicts a car 200 and oven 300. Heat source 100 is heated and is to be used for radiantly heating sauna 400. In the preferred embodiment, heat source 100 is comprised of insulating fire bricks 10 with spaces or gaps 600 between adjoining bricks (a few such spaces indicated in FIG. 2). As the reader can appreciate, the bricks may be identical, or the composition and formation of bricks may vary in weight and dimension from one another. In one embodiment, each brick 10 nominally weighs twenty pounds and is about twenty inches by ten inches by three inches. In the preferred embodiment, bricks comprised of embedded natural minerals (shown as specks 700 in one brick 10) are used which have been shaped as depicted and formed into rectangular shapes. Special mineral bricks are preferred because of their ability to be stacked, their ability to heat and dissipate heat effectively for the purpose of a spa, their aroma, and their appearance. Of course, other bricks, tiles, blocks, or other heat retaining elements may alternatively be used. In the preferred embodiment, bricks 10, which together form the exterior of brick heat source 100, are arranged in a pattern such that bricks 10 are stacked one on another with gaps 600 between said bricks. This stacking, resembling a three dimensional cube with spaces between said bricks, a hollow interior to the cube, and an open top and bottom to the cube. In the preferred embodiment, bricks 10 are also arranged in a pattern with a large opening in the midst of heat source 100. Other patterns may alternatively be used. In the preferred embodiment, heat source 100 is approximately nine feet long, five feet wide, and four feet high. The gaps allow air to circulate between the bricks and to provide a faster and more even heating of sauna 400. Moreover, the bricks are also heated faster and evenly when the structure is in the oven.

Car 200 is formed of palette 20 which is attached to an undercarriage with wheels 25. Wheels 25 rest and roll on rails 30. Heat source 100 rests on palette 20. In the preferred embodiment, palette 20 is formed of a heavy-duty carbon steel frame, although other materials or composites capable of supporting a brick structure may also be used. In the preferred embodiment, palette 20 includes side channels to aid in maintaining heat source 100 in place and aid in sealing oven 300 when car 200 is introduced into oven 300.

In the preferred embodiment, car 20 has four wheels 25 on axles (not shown) but additional wheels 25 and axles may also be used. Two such wheels are shown with two others hidden from view on distal side of car 200. In the preferred embodiment, wheels 25 are eight-inch cast iron V-grooved wheels, each having an interior flange insulating fire brick base with two channel sides. In the preferred embodiment, rails 30 are at least twenty-five feet long, such that car 200 can travel about 14 feet but other lengths may be used as appropriate, depending upon the length of car 200 and the locations and sizes of oven 300 and sauna 400 relative to one another. In an alternate embodiment, a track without rails may be used or wheels may be used that do not require tracks or rails.

Car 200 is driven by drive 3 mounted on the rear of car 200. Drive 3 drives the rear axle of car 200. Drive 3 is an off the shelf AC or DC motor such as the Hub City Model HI 4063. Drive 3 should have a high enough power rating to transport the combined weight of car 200 and heat source 100.

As discussed above and depicted in FIG. 1, car 200 can selectively be located either in position A in the oven or in position B in the sauna. The reader is re-directed to FIG. 1, which shows the different locations for car 200. Car 200 can be in oven 300 where heat source 100 is heated, or in sauna 400 where heat source 100 dissipates heat to the room.

Door 50 separates control room 300 from sauna 400. Door 50 in the closed position is latched by a plurality of door latches 6. Door 50 in the closed position serves as an insulator and should remain closed except to allow car 200 to be transported between sauna 400 and oven 300. Door 50 is operated by electrical motor gearbox 55, located along the door frame, and should to activated before drive 3 is activated. Each latch 6 is an off-the-shelf electrical cylinder latch, such as Model LAO55L made by Joyce/Dayton Corp. of Dayton, Ohio.

FIGS. 1 and 2 also show a plurality of heating elements 40 located within oven 300. In the preferred embodiment, eighteen such heating elements are used, however other quantities may alternatively be used. As can be seen in FIGS. 1 and 2, heating elements 40 located in oven 300 rest parallel to one another and are attached from the ceiling so as to permit heat source 100 to be moved underneath them. In the preferred embodiment, each heating element 40 is seven feet long, although other dimensions may alternatively be used. Heating elements 40 are off the shelf electrical elements.

Figure 3:
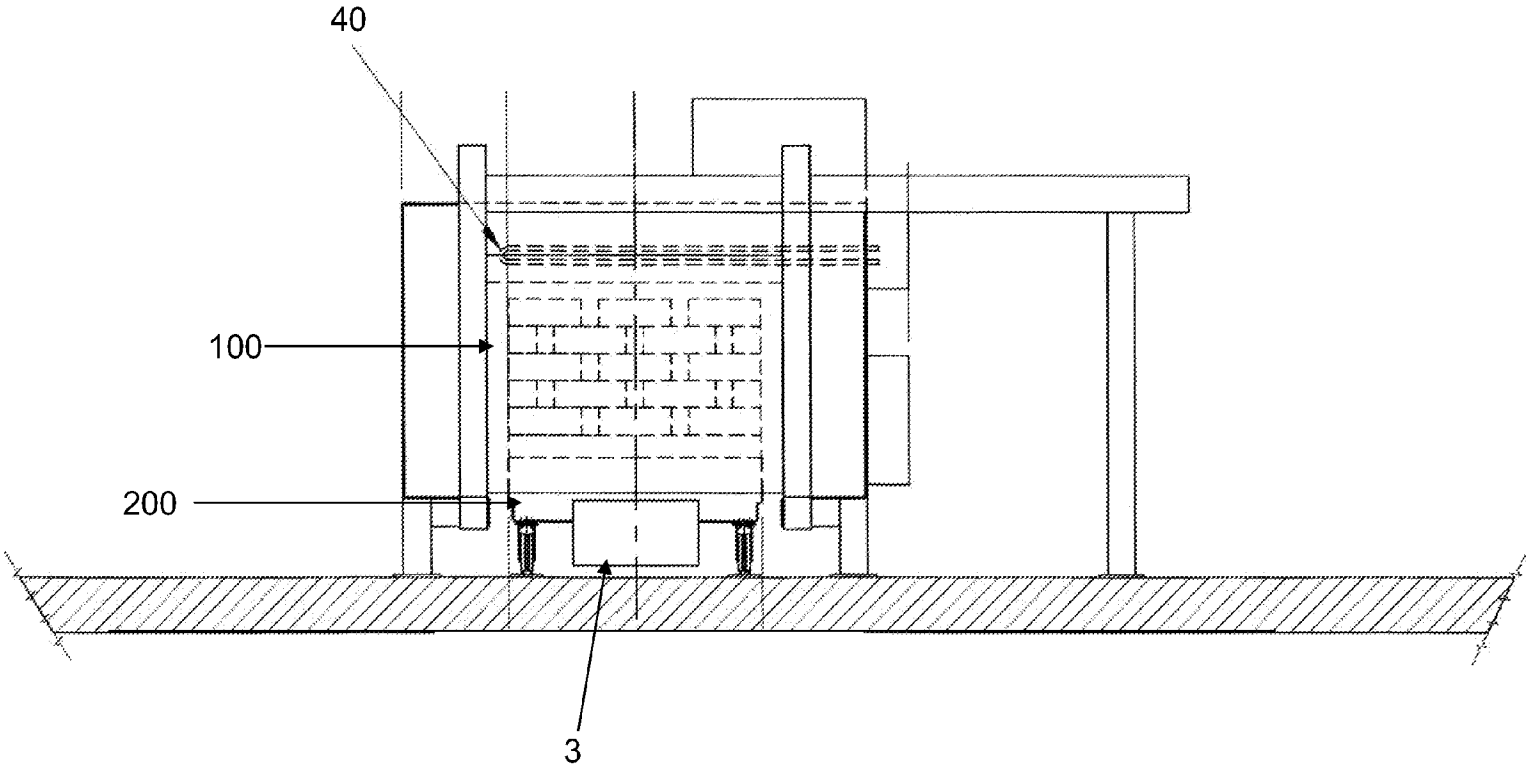
FIG. 3 is a perspective view of the heat source and vehicle of the present invention from the rear.

FIG. 3 shows a perspective view of car 200 disposed in oven 300. As can be appreciated from FIG. 3, heating elements 40 are located such that they are above heat source 100 on car 200.

Also provided in oven 300 is circulation fan 1 that directs air heated by heating elements 40 to flow around heat source 100. Heater control panel 7 in oven 300 controls heating elements 40. Heater control panel 7 is an off-the-shelf panel such as Antech, Inc., Model 60697, 480 V, three phase, 150 AMP, with SCCR rating 5K. As can be appreciated from FIGS. 1 and 2, circulation fan 1 is mounted in oven 300 adjacent to where heat source 100 would generally rest.

In the preferred embodiment, circulation fan 1 is a single plug fan, consisting of a single stainless steel inlet impeller assembly with a stainless steel inlet bell-mouth. For example, circulation fan 1 may be a DF Fan Services, Inc. UC 1⅜ assembly plug fan with shaft diameter of 1⅜ inches and a rating of 6000 cfm. A plug fan is preferred because of its ability to provide a sizable flow of air, its ability to withstand high temperatures, and its low maintenance requirement. Other fans with similar characteristics or a plurality of similar fans may alternatively be used. Other types of fans with other shaft diameters and ratings may be used and other types may be preferred based on, for example, room sizes. Circulation fan 1 is driven by an off the shelf electric motor. In the preferred embodiment a Baldor 5 hp TEFC (total enclosed fan cooled) motor is used. Although other off the shelf motors may be used, a TEFC motor is preferred so as to provide for protection from environmental elements.

Type "J" temperature probes (not shown) are mounted throughout oven 300 to measure the temperature within oven 300, including in the area surrounding heat source 100.

The system operates as follows. Initially, for example, early in the morning, sauna 400 and structure 100 disposed therein are at a low room temperature. On request by a user or in response to a signal from a timer, a heating stage is performed as follows. Doors 50 and 51 open and car 200 with structure 100 is automatically transferred from sauna 400 into oven 300. The doors are then closed, sealing car 100 inside. Next, the heaters are activated and the heated air generated by the heaters and circulated by circulation fan 1 is blown in and around structure 100 causing the structure to heat up. The temperature of structure 100 is elevated by the process. In the preferred embodiment, the prescribed temperature is 750° F. Once the ambient temperature reaches the prescribed temperature, the heating elements are turned off and car 200 is moved into sauna 400 through doors 50 and 51 remotely driven using drive 3. In the preferred embodiment, the movement of car 200 is controlled remotely. Electrical motor gearbox 55 is used to control the opening and closing of doors 50 and 51. Car 200 with structure 100 rolls through doors 50 and 51 and into sauna 400 over rails and is locked into position. The heat of structure 100 causes the temperature of sauna 400 to elevate. As the temperature of sauna 400 elevates, structure 100 cools. After temperature equilibrium is reached, structure 100 and sauna 400 begin to concurrently cool (consequential to, for example, people opening a door to enter of leave sauna 400 which would allow colder air to enter). After a lower threshold ambient temperature is reached, car 200 is transported back to oven 300 for re-heating.

Preferably, a microprocessor deposed in control panel 7 is used to control all electrical functionality, including heating elements 40, movement of car 200, circulation fan 1, door 50, and electrical motor gearbox 55. Control of the microprocessor may be manual or automatic. Control panel 7, oven control and motor panel 8, and brick car remote panel 9 provide manual interfaces for controlling the microprocessor.

The temperature range of sauna 400 is controllable by a thermostat (not shown) connected to the microprocessor. Initially, the sauna heats up to a nominal temperature range of 100-150° F., with a nominal mean of 125° F. Thereafter, it starts cooling down. When the ambient temperature of sauna 400 falls below a second threshold temperature (e.g., 122° F.), car 200 with structure 100 is transported back to over 300 for re-heating. The time to initially heat structure 100 during the heating stage and the time to cool structure 100 to the threshold depends on several variables such as the initial temperature of the structure at the end of the heating cycles, the weight (and therefore the heat capacity) of structure 100. It was found that the process works for several hours with the temperature range of 122° F. to 750° F.

It will thus be seen that the objects set forth above, among those made apparent from the preceding description, are efficiently attained and, since certain changes may be made in carrying out the above process, in the described product, and in the construction set forth without departing from the spirit and scope of the invention, it is intended that all matter contained in the above description and shown in the accompanying drawings shall be interpreted as illustrated and not in a limiting sense.

It is also to be understood that the following claims are intended to cover all of the generic and specific features of the invention herein described, and all statements of the scope of the invention which, as a matter of language, might be said to fall therebetween.

I claim:

1. A sauna system comprising:

an oven having a plurality of electrically-activated heating elements and a circulation fan;

a transportable surface with wheels;

a sauna sized and shaped to accommodate a plurality of patrons; and a heat source mounted on said surface and selectively movable between said oven and said sauna, said heat source being adapted to selectively heat said sauna to a temperature of at least 750° F.

2. The system of claim 1, wherein said heat source is formed of bricks.

3. The system of claim 2, wherein said bricks are arranged in a pattern with a gap between adjoining bricks.

4. The system of claim 1, wherein said heat source is formed of bricks with embedded minerals.

5. The system of claim 4, wherein said bricks are arranged in a pattern with space between adjoining bricks.

6. A method of heating a room associated with an adjacent oven comprising the steps of:

arranging a plurality of heat retaining objects on a transportable surface;

positioning the surface in the oven;

activating a plurality of heating elements and a circulation fan in the oven to heat said plurality of heat retaining objects to heat a preselected temperature; and transporting said transportable surface to a room;

wherein said room is heated through radiation of heat from said heat retaining objects to said room.

7. The method of claim 6, wherein said heat retaining objects are bricks.

8. The method of claim 6, wherein said heat retaining objects are bricks with embedded minerals.

9. The method of claim 7, wherein said arrangement is in a pattern with a gap between adjoining bricks such that the rate of heat dissipation is substantially slower than bricks arranged on the same level and without said spacing.

10. The method of claim 6, wherein the temperature of said heat retaining objects is elevated to a first threshold temperature.

11. The method of claim 10 further comprising returning said transportable surface with plurality of heat retaining objects to be reheated when the ambient temperature of said heatable room falls below a second threshold temperature, wherein said second threshold temperature is below said first threshold temperature.

12. A method of heating a room comprising the steps of:

providing bricks in a pattern with openings between said bricks on a transportable surface;

heating said bricks in an oven by electrically activating a plurality of heating elements and a circulation fan and with said bricks positioned on said transportable surface; and transporting said bricks to a room;

wherein said room is heated through dissipation of heat from said bricks.

13. The method of claim 12, wherein said are bricks include embedded minerals.

14. The method of claim 12, wherein said is pattern includes a gap between adjoining bricks such that the rate of heat dissipation is substantially slower than bricks arranged on the same level and without said spacing.

15. The method of claim 12, wherein the temperature of said bricks is elevated to a first threshold temperature.

16. The method of claim 15 further comprising returning said transportable surface with plurality of bricks is to be reheated when the ambient temperature of said room falls below a second threshold temperature, wherein said second threshold temperature is below said first threshold temperature.

* * * * *